United States Patent [19]

Thurston

[11] Patent Number: 5,009,541

[45] Date of Patent: Apr. 23, 1991

[54] PLASTIC BARRICADE WITH LIMITING BOLT

[76] Inventor: Kurt W. Thurston, 475 Hill St., Reno, Nev. 89501

[21] Appl. No.: 470,394

[22] Filed: Jan. 25, 1990

Related U.S. Application Data

[63] Continuation-in-part of Ser. No. 326,615, Mar. 21, 1989, abandoned, and a continuation of Ser. No. 383,298, Jul. 20, 1989.

[51] Int. Cl.[5] ..... E01F 13/00; E01F 15/00

[52] U.S. Cl. ..... 404/6; 116/63 P; 256/64

[58] Field of Search ..... 404/6, 9; 40/610; 116/63 P

[56] References Cited

U.S. PATENT DOCUMENTS

| | | | |
|---|---|---|---|
| 1,750,118 | 3/1930 | Mueller, Jr. et al. | 40/610 |
| 1,845,590 | 2/1932 | Edwards | 40/610 |
| 3,557,479 | 1/1971 | Allison et al. | 40/610 |
| 3,691,526 | 9/1972 | Huntington | 40/610 |
| 3,802,667 | 4/1974 | Kanan | 404/6 |
| 3,917,232 | 11/1975 | Lindner | 404/6 |
| 4,005,537 | 2/1977 | von Camber et al. | 40/610 |
| 4,085,762 | 4/1978 | O'Brian et al. | 40/610 |
| 4,231,676 | 11/1980 | Smith et al. | 404/6 |
| 4,253,260 | 3/1981 | Maza et al. | 40/610 |
| 4,279,105 | 7/1981 | Cameron | 404/6 |
| 4,298,186 | 11/1981 | Glass | 404/6 |
| 4,300,300 | 11/1981 | Neuland et al. | 40/610 |
| 4,372,536 | 2/1983 | Morse | 404/6 |
| 4,383,782 | 5/1983 | Pillifant, Jr. | 404/6 |
| 4,411,085 | 10/1983 | Farmer | 40/610 |
| 4,624,210 | 11/1986 | Glass | 404/6 |
| 4,796,369 | 1/1989 | Hamann | 40/610 |

*Primary Examiner*—Ramon S. Britts
*Assistant Examiner*—Gay Ann Spahn

[57] ABSTRACT

A plastic barricade includes improved hinges which can be freely opened to an almost flat position so that no unwanted forces cause breakage of the hinges. Limiting bolts are placed in recesses on each face of the barricade so that the bolts in the normal active position will limit the opening or unfolding of the frame units of the barricade to, for example, 40°, but when closed will still present a planar surface with the bolt heads being recessed so that stacking of one barricade on the other will not be interfered with. In addition, a slot is cut in the middle panel member to allow insertion of a road warning sign and horizontal support platform for warning lights is also provided.

3 Claims, 5 Drawing Sheets

PLASTIC BARRICADE WITH LIMITING BOLT

This is a continuation-in-part of application Ser. No. 326,615 filed Mar. 21, 1989 now abandoned, and also a continuation of Ser. No. 383,298 filed July 20, 1989.

FIELD OF THE INVENTION

The present invention is directed to plastic barricades and more specifically to one with a limiting bolt for effectively positioning the barricade in unfolded freestanding position.

DESCRIPTION OF THE PRIOR ART

Plastic barricades are well known as, for example, shown in Glass U.S. Pat. No. 4,298,186. As described in that patent, one difficulty with a plastic barricade is that the plastic material of the hinges is more susceptible to breakage than the wood or metal type barricades. And such hinges have been used for the dual purpose of both allowing the frame members of the barricade to pivot from folded to an unfolded freestanding position and to limit the opening of the two frame units of the barricade to an angle, for example, 30°-50°, suitable for its intended use as a freestanding barricade. Wood and/or metal barricades, because of the nature of the material, resist breakage much more effectively for this limiting purpose. With a plastic barricade, various modifications of the hinge per se have been made, as shown in the Glass patent, to provide a limiting function. However, these techniques have not been altogether satisfactory.

In fact, when breakage has occurred, for example, in the hinge of a plastic barricade thereby allowing it to unfold to an undesired angle or be totally unfunctional, a hole has been drilled near the hinge portion and a bolt inserted to limit movement. This was unsatisfactory in that the protruding bolt prevented effective stacking and the hinge, being still broken, made the barricade not fully operable or effective. (Or at least subject to more limited life.)

OBJECTS AND SUMMARY OF INVENTION

It is therefore a general object of this invention to provide an improved plastic barricade with effective limiting means for placing the barricade in a freestanding unfolded position.

In accordance with the above object, there is provided a plastic barricade constructed from two substantially similar generally planar frame units and which are one piece, hollow, and integrally molded, the units being hinged together to pivot around a common axis of rotation. Each of the frame units has left and right edges when an outside face of the hinged barricade is directly viewed by an observer. The improvement comprises hinge means at the top of each of the frame units including near the left edge a cylindrical male boss and near the right edge a C-shaped female socket for snapping onto the male boss and freely pivoting thereon. Such hinge means normally allow the two frame units to pivot open or unfold to an angle substantially greater than a predetermined angle used when placing the barricade in a freestanding position. Means are further provided for maintaining the barricade at the predetermined angle of the unfolded freestanding position, including for each frame unit a pair of recesses in the planar surface near each one of the edges and below the hinge means. Each recess has an aperture for accepting a machine type bolt, having a head on one end and a screw thread on the other end for one frame unit, and a nut at the other end for the other frame unit. The bolt has a length less than the distance between the planar outside faces of a folded barricade.

DESCRIPTION OF THE PREFERRED EMBODIMENT

Figure 1:
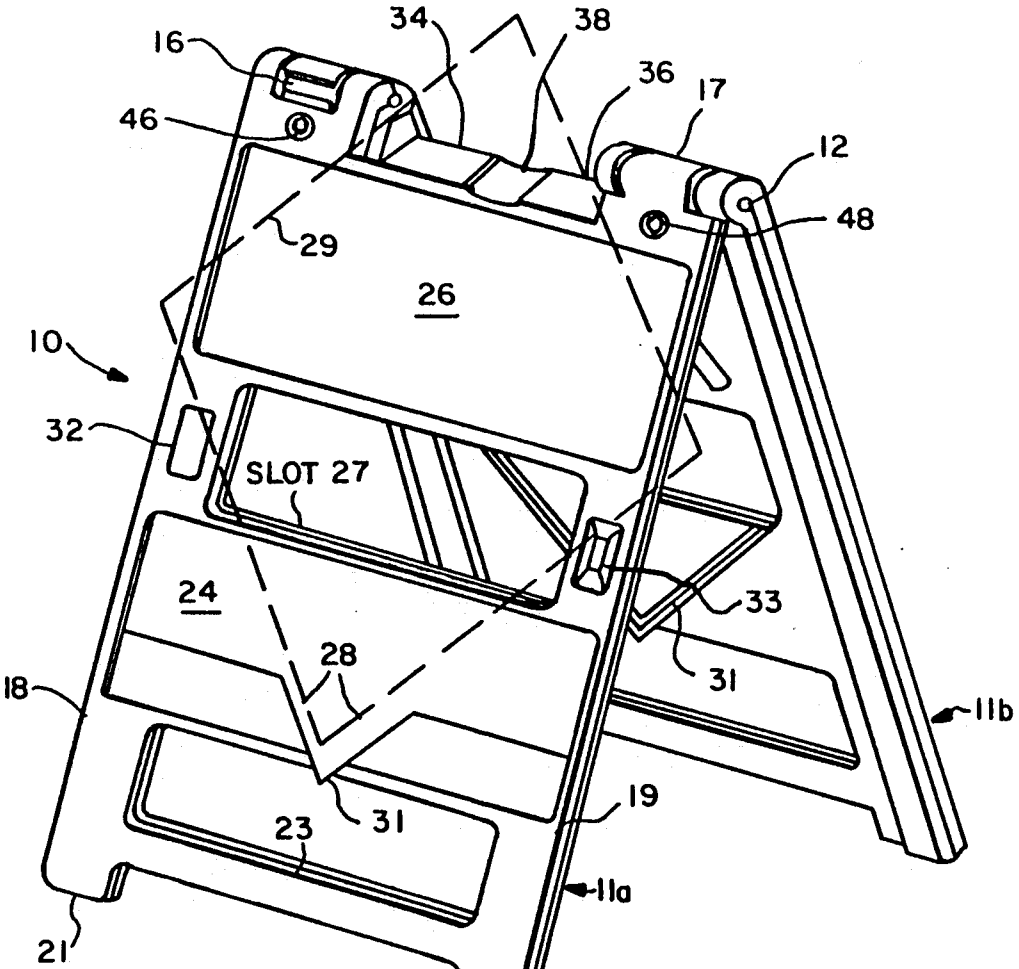
FIG. 1 is a perspective view of the plastic barricade of the present invention, showing it in an unfolded freestanding position.

FIG. 1 shows the plastic barricade of the present invention generally indicated by the numeral 10, which consists of a pair of identical generally planar frame units 11*a* and 11*b*. These units are one piece hollow integrally molded units. In general, such a frame unit is shown in the above-mentioned Glass patent. The frame units are hinged together at their top along the axis 12 which will be described in detail below. Since the units are substantially identical, this means that in the plastic molding process only a single die may be used, thus, considerably lessening costs.

Figure 2:
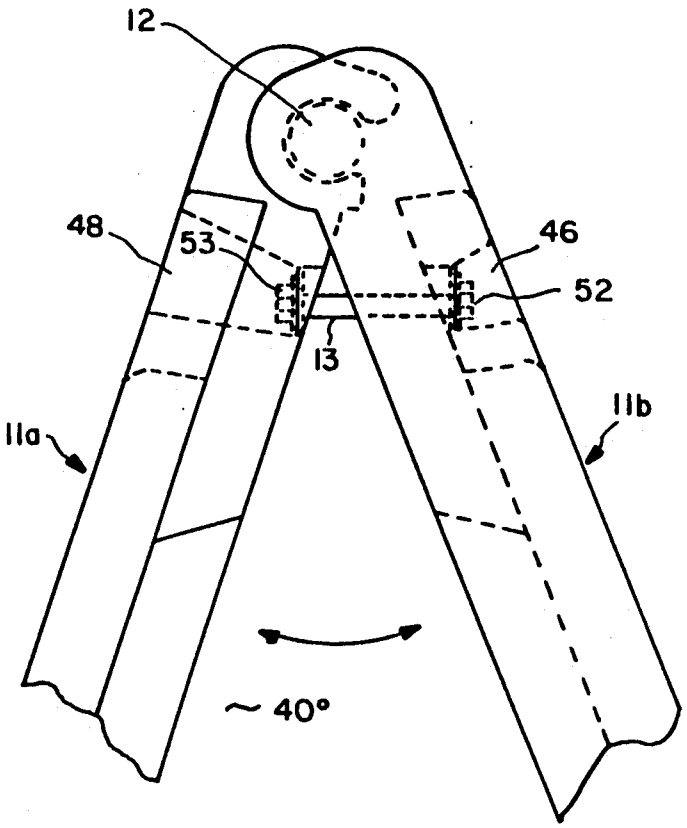
FIG. 2 is a partial side view of the top portion of FIG. 1.

Referring briefly also to FIG. 2, when the barricade is in its normal freestanding position, the two frame units are open to an angle of substantially 40°. The bolt 13 is used to limit the opening of the barricade to this position, as will be discussed in greater detail below. However, without the bolt, the left and right hinge means 16, 17 at the top of each frame member, allow the barricade to open or freely pivot to a much greater angle than the normal 40° angle; in fact, in the case of the present hinge, to substantially totally unfold to a position where both frame units 11*a* and 11*b* are in the same plane. Thus, this construction does away with any unwanted stress on the hinge member preventing it from being broken.

Referring specifically to the detailed construction of a frame unit 11*a* (the other unit is identical, of course), it includes a left frame leg 18 and a right frame leg 19 which begin at the feet 21 and 22 which rest on the ground terrain and terminate in the hinges 16 and 17. Cross connecting the two legs 18 and 19 are a lower bar 23, a middle panel 24, and a top panel 25. In typical practice, both the top and middle panels may have a reflective material placed on them. In addition, the middle panel 24 may include a slot 27 into which the triangular point 28 of a road-warning sign 29 may be inserted, as illustrated in phantom. Thus, the point 28 would not be visible since it is within the panel and the legend on the warning sign 29 would have to be above that triangular portion. As more clearly illustrated in the frame unit 11*b*, the supporting structure or ribs 31 are also configured to accept the triangular point 28 and such ribs 31 act as a seat against which the triangular point 28 rests.

Finally, as illustrated in the case of the frame unit 11*a*, there is a rectangular indentation 32 in the left leg 18 and a protrusion 33 in the right leg which serves as interlocking means for stacking the panels one on top of the other. Such interlock technique is disclosed in co-pending application Ser. No. 183,382 filed Apr. 13, 1988, entitled "Interlocking Stacking Plastic Barricades" in the name of the present inventor. To accommodate the sign 29 these rectangular interlocking 32 and 33 may have to be slightly modified so that their top ends do not interfere.

At the top portion of the barricade between the hinges 16 and 17 are support surfaces 34 and 36 which are formed integrally with the frame member and which are horizontal when the barricade is in an unfolded position and can be used for the placement of warning lights. Typically a hole is drilled along axis 12 in the boss type hinge 16 along a bolt to be inserted to retain a warning light.

Figure 3:
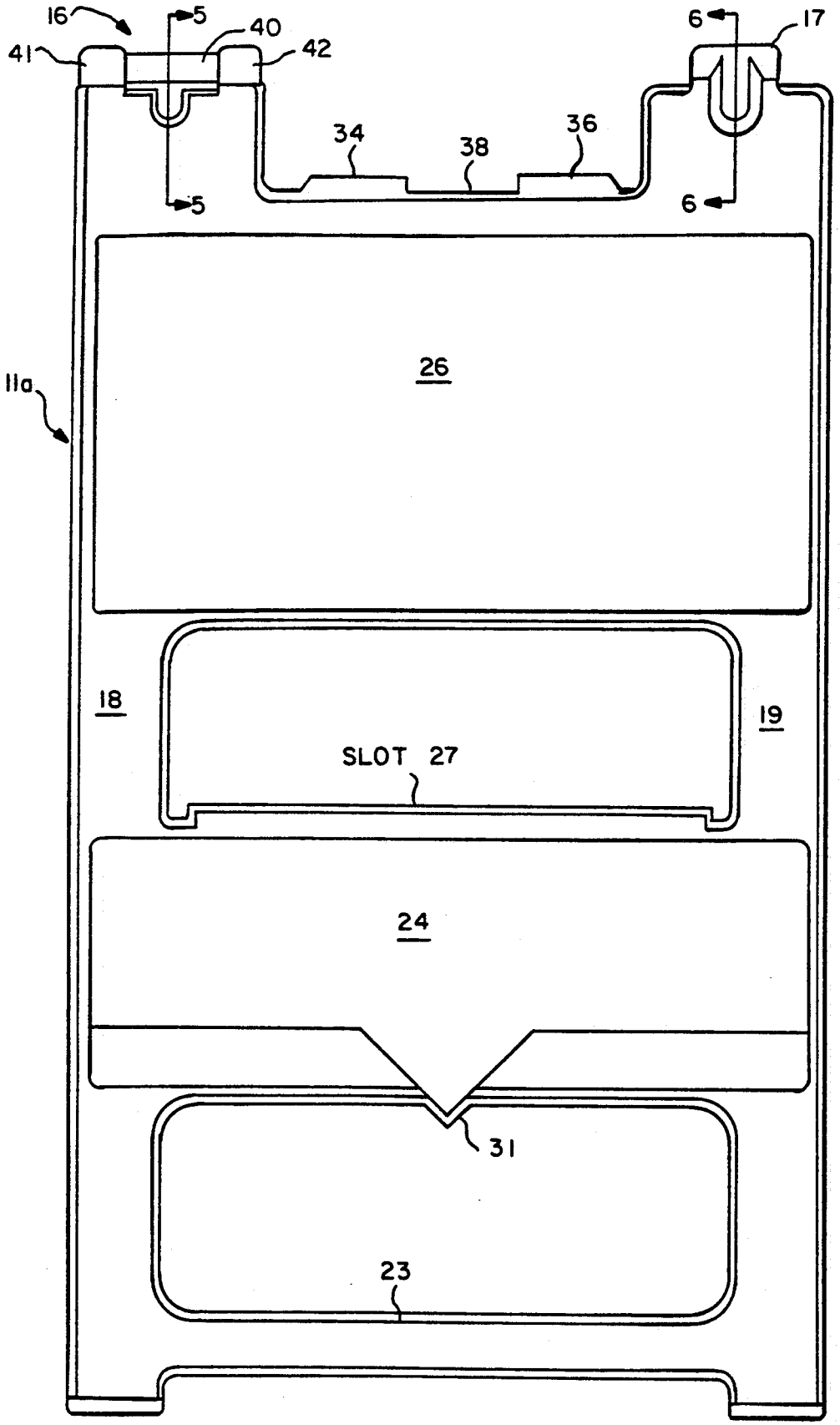
FIG. 3 is a plan view of the front or outside face of a frame member of the barricade.
Figure 4:
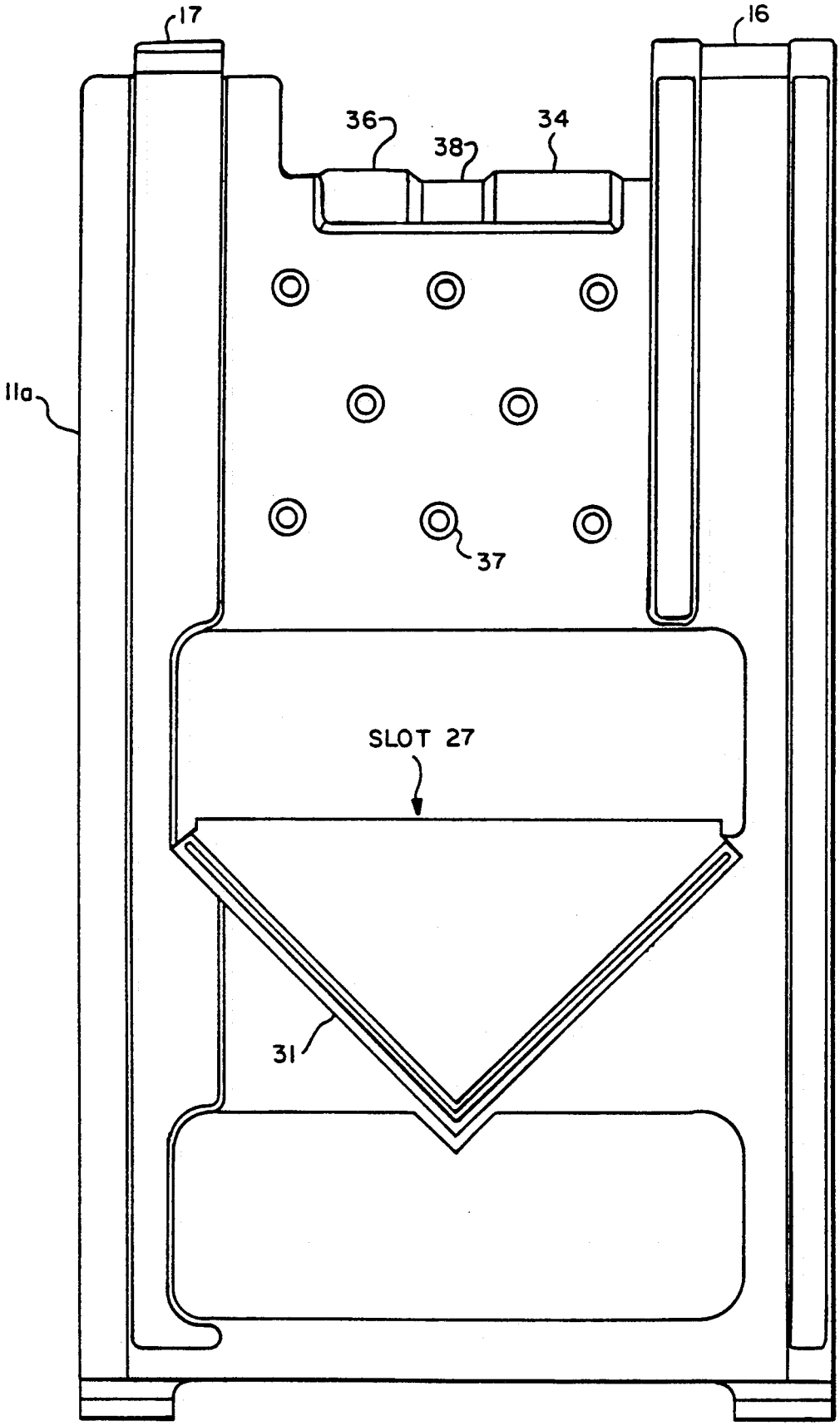
FIG. 4 is a plan view of the inside or back face of the same frame member.

FIG. 3 shows the front or outside face of frame member 11*a* (and for that matter, frame member 11*b*) in a somewhat more simplified format than FIG. 1. The support surfaces 34, 36 are more clearly shown in FIG. 4, which should also be referred to, which shows the back of the same panel 11*a*. The support surfaces are of course more fully developed in this view, as also illustrated in FIG. 1, since they fill in the space between the two frame members when they are unfolded. The notch 38 or spacing between support platforms 34 and 36 is for the purpose of allowing a hand hold to pick up the barricade and to prevent any pinching of the hand as the barricade collapses. The hinges 16 and 17, of course, are reversed in position since the view is opposite to that in FIG. 3. The triangular rib formation 31 is also more clearly shown. The circled indentations at 37 are for the use in the plastic molding process and for enhancing the durability of the barricade.

Figure 5:
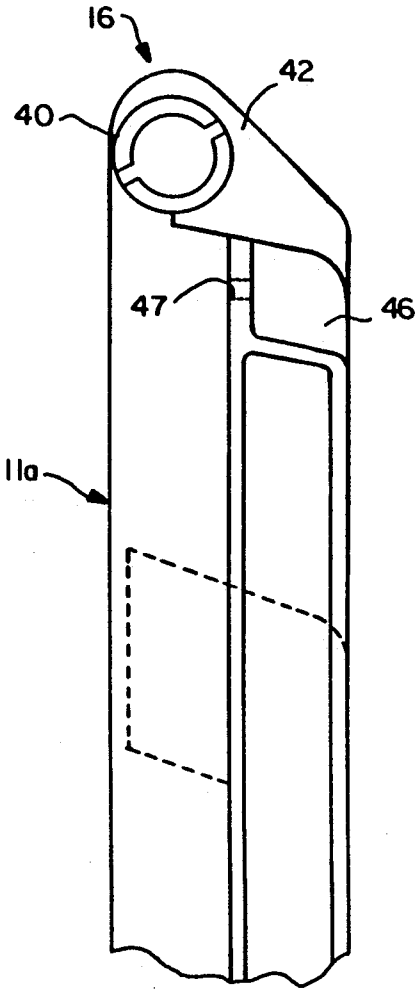
FIG. 5 is a simplified cross-sectional view taken along line 5—5 of FIG. 3.
Figure 6:
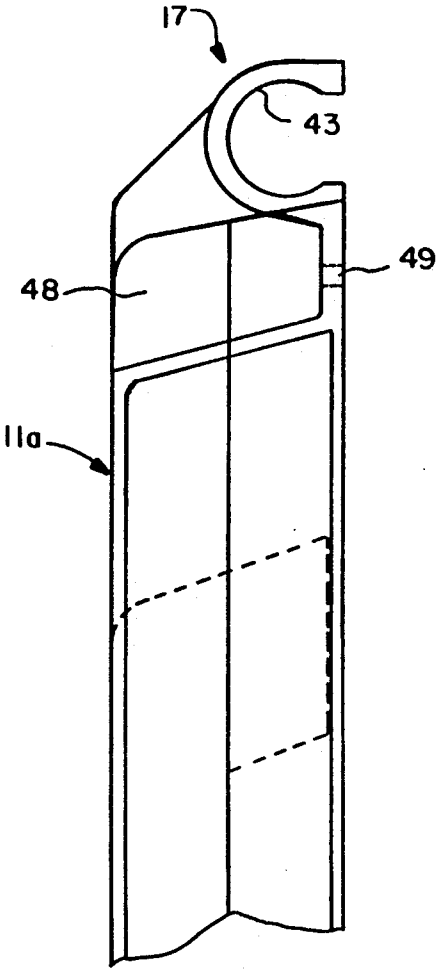
FIG. 6 is a simplified cross-sectional view taken along the line 6—6 of FIG. 3.

Details of the hinges 16 and 17 are more clearly shown in FIGS. 5 and 6, which are cross-sectional views of the hinges, as illustrated in FIG. 3. Hinge 16, which is on the left side of the frame unit as shown in FIG. 3, is a cylindrical boss type unit 18 which is molded between supports 41 and 42. In FIG. 6 the hinge 17 is merely an open C-type clamp 43. The open part of the C is of course flexible so that this female type socket can be snapped onto the male boss 40. Other equivalent cross-sections of male boss 40 can be used; for example, it can be a semicircle, etc. All that is necessary is that there be free pivoting so that no unwanted forces are applied to the relatively fragile plastic hinge.

Figure 7:
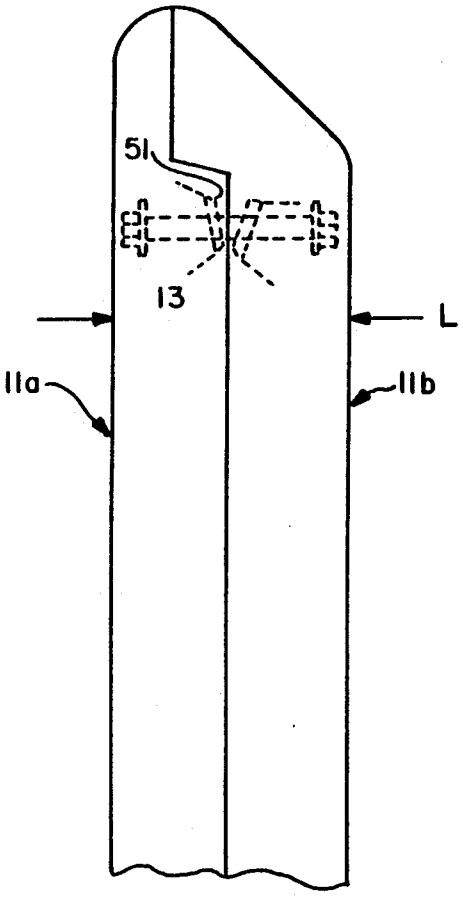
FIG. 7 is a side view showing FIG. 2 in a folded or closed position.

Below hinge 16 (see FIG. 5) is a recess 46 having an aperture 47 at its end. Similarly, in the case of FIG. 6 and hinge 17, there is a recess 48 having an aperture 49. This provides a through aperture from one face of each frame member 11*a* (or 11*b*) from one side to the other. Thus, as is more clearly illustrated in FIG. 2, the limiting bolt 13 may be inserted there-through and by the use of the bolt head 51 and the nut 52 on the other end (and washers, if necessary), this machine type bolt will limit the unfolding of the barricade to its predetermined free-standing angle which is indicated in FIG. 2 as substantially 40°. At the same time the length of the bolt type fastener 13, as illustrated in FIG. 7, is shorter or less than the distance between the planar outside faces of a folded barricade indicated as the distance L in FIG. 7. When the barricade is folded, as illustrated in FIG. 7, and another barricade stacked on it, the bolt will automatically be pushed to the neutral position shown in FIG. 7. Suitable stops (not shown) can also be used if desired. For example, a Cotter pin could be inserted at the space 53. Bolt 13 can also be replaced with an equivalent fastener.

As illustrated in FIG. 1, there are, of course, because of the nature of the molding function, two locations—both recesses 46 and 48—in which the limiting bolt 13 can be placed. It is obvious that only one bolt need be placed for effective operation.

Figure 8:
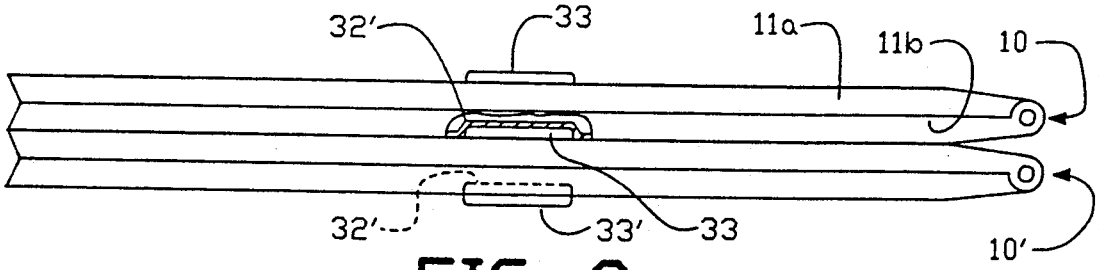
FIG. 8 is a side view partially cut away of two stacked barricades.

As discussed above, the interlocking of stacked barricades, as illustrated in FIG. 8 by the barricade 10 stacked on a barricade 10', is provided as shown in FIG. 1 by the rectangular indentation 32 and the protrusion 33 on the outside face of each of the frame units. Thus, when the barricade 10 is stacked on the barricade 10', the protrusion 33 nests within the indentation 32' which is on the outside face of the frame unit 11*b*. Thus, assuming the same lengthwise orientation of a barricade, one folded barricade may be stacked on the other with the interlocking means automatically mating and with the planar faces of the frame units abutting each other. Moreover, in view of the construction of the fastener 13 and its recesses, this is done without obstruction or interference from the fasteners.

Figure 9:
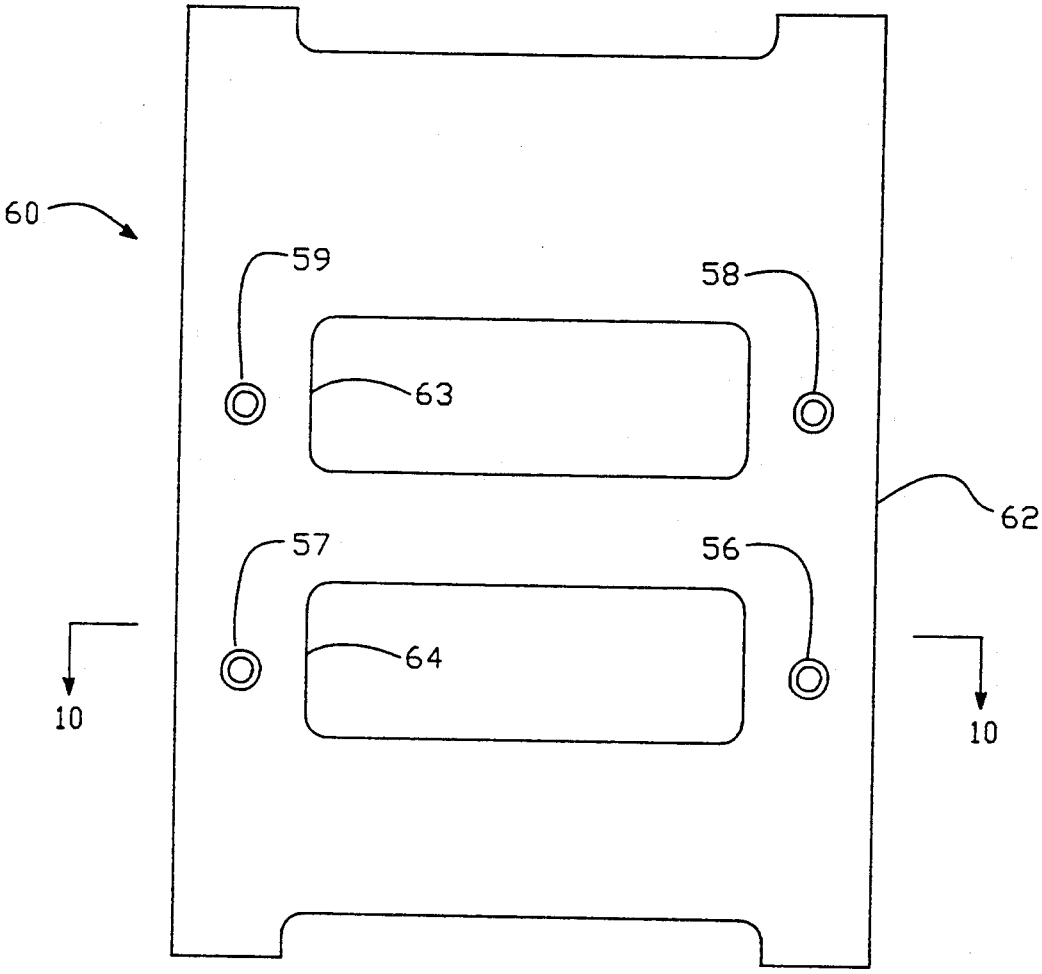
FIG. 9 is an elevation view of an alternative embodiment of FIG. 1.
Figure 10:
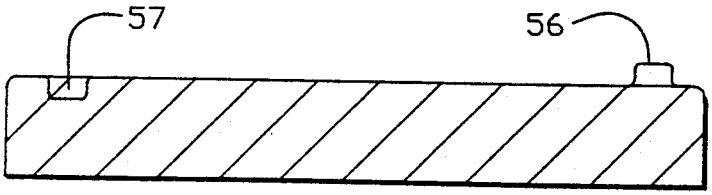
FIG. 10 is a simplified cross-sectional view taken along the line 10—10 of FIG. 9.

Rather than rectangular configurations, circular configurations may also be used, as shown in FIGS. 9 and 10, where a modified frame unit 60 is shown with left and right edges 61 and 62. Near the left edge 61 are circular indentations 57 and 59, and near the right edge 62 are circular protrusions 56 and 58. (These are better shown in FIG. 10.) In any case they interlock in the same manner, as illustrated in FIG. 8, with the rectangular interlocking devices. The foregoing interlocking procedure is more fully explained in the above-mentioned co-pending application. Thus, an improved plastic barricade has been provided which, by the use of a freely pivoting hinge, minimizes breakage of the relatively fragile plastic material. This in combination with the recessed areas allows the limiting bolt to be in place without affecting the necessary stacking facility of the barricades.

Such stacking is made possible by the built-in interlocking devices.

I claim:

1. A plastic barricade constructed from two substantially similar frame units each having a planar outside face and which are one piece, hollow, and integrally molded, such unit being hinged together to pivot around a common axis of rotation, each of said frame units having left and right edges when an outside face of said hinged barricade is directly viewed by an observer in front of the face of a freestanding barricade, the improvement comprising:

hinge means at the top of each of said frame units including near said left edge a cylindrical male boss and near said right edge a C-shaped female socket for snapping onto said male boss and freely pivoting thereon said hinge means normally allowing said two frame units to pivot open or unfold to an angle substantially greater than a predetermined angle used when placing said barricade in a free-standing position;

means for maintaining said barricade at said predetermined angle of said unfolded freestanding position, including for each frame unit a pair of recesses in said planar outside face near each one of said edges and below said hinge means each said recess having an aperture for accepting an elongated fastener having limiting means on both ends for abutting against said recesses when said barricade is unfolded to its predetermined angle said fastener having a length less than the distance between the planar outside faces of a folded barricade;

each of said frame units including at least one pair of interlocking means located on said outside face of each of said frame units proximate to said left and right edges of said frame unit, one of said pair of interlocking means being an indentation in and the other a protrusion from said outside face, said indentation and protrusion being dimensioned and shaped to closely mate together, said protrusion for each of said two frame units of said barricade always being located on a predetermined one of said left and right edges, whereby assuming the same lengthwise orientation of a barricade, one folded barricade may be stacked on another with the said interlocking means automatically mating with said planar faces of said frame units abutting each other, and without obstruction or interference by said fasteners.

2. A barricade as in claim 1 where each frame unit includes spaced apart frame legs with a lower, connecting bar and middle and upper connecting panels said middle panel including a top slot for receiving a triangular point of a road warning sign and a bottom seat portion against which said point of said sign may rest, said bottom seat portion including a pair of V-oriented ribs against which said point may rest, said ribs sealing said hollow portion of said barricade from said slot, whereby ballasting within said hollow of said barricade cannot escape through said slot.

3. A barricade as in claim 2 including platform means on the top of said upper connecting panel for providing a substantially horizontal support surface in an unfolded position for warning lights.

* * * * *